US007851392B2

(12) United States Patent
Davis

(10) Patent No.: US 7,851,392 B2
(45) **Date of Patent: *Dec. 14, 2010**

(54) LIGHTWEIGHT NONWOVEN FIRE RETARDANT BARRIER

(75) Inventor: Greg Davis, Owings Mills, MD (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/166,152

(22) Filed: Jul. 1, 2008

(65) Prior Publication Data

US 2009/0053494 A1 Feb. 26, 2009

Related U.S. Application Data

(63) Continuation of application No. 10/979,107, filed on Nov. 2, 2004, now Pat. No. 7,410,920.

(51) Int. Cl.

| | |
|---|---|
| ***D04H 1/00*** | (2006.01) |
| ***D04H 13/00*** | (2006.01) |
| ***D04H 3/00*** | (2006.01) |
| ***D04H 5/00*** | (2006.01) |

(52) U.S. Cl. ..... 442/414; 428/920; 428/921; 442/334; 442/340; 442/344; 442/346; 442/415

(58) Field of Classification Search ..... 442/334, 442/340, 344, 346, 414, 415; 428/920, 921
See application file for complete search history.

(56) References Cited

U.S. PATENT DOCUMENTS

| | | | |
|---|---|---|---|
| 3,870,590 | A | 3/1975 | Hurwitz |
| 5,677,028 | A | 10/1997 | Ravella |
| 7,589,037 | B2 | 9/2009 | Handermann et al. |
| 7,703,405 | B2 | 4/2010 | Bridgeman et al. |
| 2004/0097156 | A1 | 5/2004 | McGuire et al. |
| 2004/0106347 | A1 | 6/2004 | McGuire et al. |
| 2004/0198125 | A1 | 10/2004 | Mater et al. |
| 2005/0026528 | A1 | 2/2005 | Forsten et al. |
| 2005/0210584 | A1 | 9/2005 | Lim et al. |
| 2006/0040580 | A1 * | 2/2006 | Ogle et al. ..... 442/389 |

FOREIGN PATENT DOCUMENTS

WO WO 03/023108 A1 3/2003

* cited by examiner

*Primary Examiner*—Norca L Torres-Velazquez
(74) *Attorney, Agent, or Firm*—Venable LLP; Keith G. Haddaway; Justine A. Gozzi

(57) ABSTRACT

A non-woven flame retardant barrier can be prepared from low denier, charring fibers and substantially free of polymers made from halogenated monomers. The charring fibers can be modified viscose fibers, for example Visil®. The blend of low denier fibers can be, for example, a blend of 1.5 denier fibers and 3.0 denier fibers.

25 Claims, No Drawings

LIGHTWEIGHT NONWOVEN FIRE RETARDANT BARRIER

This application is a Continuation of U.S. patent application Ser. No. 10/979,107 to Davis, filed Nov. 2, 2004 entitled "Lightweight Fire Retardant Barrier," the subject matter of which is being incorporated herein by reference in its entirety.

FIELD OF THE INVENTION

The present invention relates to a lightweight fire retardant barrier for use in products such as mattresses and furniture. More particularly, the invention relates to a lightweight fire retardant barrier prepared from low denier, charring fibers. The fire retardant barrier can comprise modified viscose rayon. One preferred embodiment includes use of a blend of fine denier charring fibers. Another embodiment includes the exclusive use of Visil®.

BACKGROUND

Various fire-retardant products are available for use in furniture, mattresses, etc. These products are made using natural or synthetic fibers to form the basis of the fabric, which can be woven, spunlace nonwoven or knit.

Fire resistance can be imparted to fibers in several ways. For example, fabric can be treated with chemicals to render it fire-retardant. However, the process of chemical treatment can weaken the fabric, causing it to crack when exposed to direct flame. Once the outlying fabric is damaged, the flame can come into contact with the underlying material, causing it to ignite. Also, treated fabrics are heavy and do not last as long as non-treated fabrics.

Other fabrics are available in the art that are not as susceptible to cracking and can withstand open flame tests. One example is a 100% fiberglass flame barrier coating a woven polymer, but fiberglass barriers have low durability due to glass-to-glass abrasion. Another option is a woven or knit core-spun yarn based flame barrier, where natural and/or synthetic fibers are wrapped around a fiberglass core, a multifilament core, or a core yarn. The fibers may be treated with a fire retardant chemical or a coating of thermoplastic polyvinyl halide composition.

Woven flame barriers suffer drawbacks in becoming very stiff when coated with fire retardant materials, making the final product less comfortable/desirable to a consumer. Also, woven and nonwoven knit flame barriers must be laminated to a decorative fabric or double upholstered during manufacturing, increasing costs.

Another disadvantage of chemically treated fire retardant material is that the treatment adds weight to the fabric, making an already cumbersome product even more difficult to handle. Also, many chemical treatments are water soluble or otherwise impermanent. Water solubility is a drawback, making the material less durable. Chemical treatment can also be costly. Thus, there is a need in the art for a lightweight fire retardant barrier that does not require chemical treatment.

Regarding nonwoven technology, fibers are bought from suppliers, usually referenced by a brand name or generic name. The fibers are carded to straighten out the fibers. Layers of carded fibers are cross lapped (one layer running north/south, then another layer running east west) over one another to build a batt. The fiber batt is then densified by either thermal bonding, needle punching, or spray bonding. Thermal bonding may be accomplished by adding low melt fibers that have a lower melting point than the other fibers and by heating the batt such that the low melt fibers melt. These fibers act as an adhesive in a web because their softening point is less than the softening point of the other fibers in the material.

Needle punching involves punching a needle plate repeatedly through the batt to physically entangle the fiber layers. Typically, the more the batt is needled, the lower the loft and the higher the strength. The loft of the nonwoven can be set by the amount of needlepunching applied. With thermally bonded material, loft can be controlled by compressing the batt in the oven and blowing air through the batt as the batt is cooled. Spray bonding may be accomplished by spraying a liquid binder (e.g. latex) onto one or both sides of the carded batt and drying and curing the batt in an oven. The nonwovens are then cut and rolled for sale to manufacturers for incorporation into products such as mattresses, furniture, etc.

WO 03/023108 describes a nonwoven highloft flame barrier which uses a blend of inherently flame retardant fibers and modacrylic fibers, i.e. fibers extruded from polymers made from halogenated monomers. However, modacrylic fibers are expensive, making it difficult to provide high quality, low cost products to consumers.

U.S. Patent Application Publication No 2004/0097516A1 describes a fire retardant nonwoven fabric for use in household goods. However, the nonwoven fabrics disclosed in the publication include more than one type of fire retardant fiber and/or a fire retardant resin used to coat fibers. The disclosed materials also use higher denier fibers and polyethylene terephthalate, which are not advantageous for flame barrier and cost efficiency.

Prior fire retardant materials generally have been produced with higher basis weight, e.g. in the 0.75-1.25 osf range for highloft barriers, and generally use relatively high denier fibers. When lower basis weight materials are produced, the material must be densified in order to increase fire resistance or charring, resulting in a product that does not have the soft feel desired for mattresses and other products. Thus, there is a further need in the art for a high loft flame barrier that retains feel characteristics desirable of mattresses, bedspreads, and the like.

SUMMARY OF THE INVENTION

The present invention is a non-woven flame retardant barrier containing low denier, charring fibers that is substantially free of polymers made from halogenated monomers. The invention's fire retardant property is due to the use of fibers that exhibit a charring effect when exposed to flame. This ability to char prevents the materials from catching fire and creates a flame barrier. In one embodiment, the fibers include low denier modified viscose fibers. In an exemplary embodiment, the low denier viscose fibers include Visil®.

Because the present invention utilizes an inherently flame retardant barrier, there is no need for a coating and the product retains a "soft feel" quality. The present invention improves upon the prior art by eliminating the need for modacrylic fibers, thus increasing efficiency in manufacturing and decreasing cost, and providing a resilient filling material at a potential lighter weight. Further, the invention does not require the use of different types of fire retardant fibers or the addition of fire retardant/fire resistant resins.

The flame retardant materials may comprise more than 50% of the formulation. In a further embodiment, less than 10% of the polymers present in the flame retardant barrier are halogenated polymers, not including any binder that may be present. Modified viscose fibers can account for more than 85% of the inherently flame retardant materials, not including any binder that may be present.

The nonwoven flame retardant barrier (or nonwoven) may have a basis weight of about 0.2 to about 0.85 osf. In a further embodiment, the nonwoven has a basis weight about 0.5 osf or less.

The nonwoven can also include a binder, present in an amount of greater than about 25%, by weight.

The nonwoven may include a blend of fibers of about 1.5 denier and about 3 denier. Particular embodiments can have between about 40-50% fibers of 1.5 denier, about 20-40% fibers of 3 denier, and about 15-30% binder. The nonwoven can have about 25-75% fibers of 1.5 denier and about 75-25% of fibers of 3 denier, not including any binder in the formulation. The nonwoven can have a ratio of fibers of 1.5 denier to fibers of 3 denier of about 1:1 to 2.5:1. Additionally, the nonwoven may be comprised of 1.5 denier fibers exclusively, or 3 denier fibers exclusively.

Higher denier fibers can also be used in a fiber blend according to the invention. For example, the nonwoven can include a blend of a low denier fiber and a higher denier fiber, or fibers of varying deniers. In one embodiment, the nonwoven can contain a fiber having a denier of about 7 or more, and a fiber having a denier of about 3 or less.

The flame retardant barrier may be a highloft nonwoven. The loft can be from about ¼ inch to about 1.5 inches. In a further embodiment, the barrier has a density of about 3 ocf to about 4.5 ocf. In a particularly preferred embodiment, the flame retardant barrier is incorporated into a mattress product that meets the requirements of Cal. AB 603.

The present invention also encompasses a method of manufacturing a nonwoven flame retardant barrier comprising carding low denier charring fibers and cross lapping the carded fibers to form a batt. In one embodiment, the method includes adding a binder to the fibers to create a fiber blend, and thermally bonding the fibers. In another embodiment, the fiber blend includes about 5 to about 30% binder. In a further embodiment, the method also includes needle punching the carded and lapped fibers. The invention further includes a highloft batt produced by this method.

In addition, the present invention relates to a method of manufacturing an article comprising carding low denier charring fibers, cross lapping the carded fibers to form a batt, and thermally bonding or needle punching the fibers. The invention also includes the method of manufacturing an article by providing the flame retardant barrier as disclosed, placing the barrier as a layer extending along a surface, and covering the surface with a fabric. The article manufactured by these methods may be a mattress, mattress foundation, sofa, chair, partition, insulator, or other furniture or houseware products. The invention is also directed to these articles of manufacture comprising the nonwoven. In an embodiment wherein the manufactured article is a mattress, the method further comprises providing a mattress material, wherein placing the barrier layer comprises placing the barrier on the top and sides of the mattress material. In an embodiment where wherein the article being manufactured is a box spring, the method further comprises providing a box spring, wherein placing the barrier layer comprises placing the barrier material on the top and sides of the box spring.

Further objectives and advantages, as well as the structure and function of preferred embodiments will become apparent from a consideration of the description, drawings, and examples.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

The present invention relates to a nonwoven flame retardant barrier that is suitable for use in, for example, mattress and furniture applications, as well as other applications that require or benefit from the use of a fire retardant fiber material. The nonwoven is prepared from inherently flame retardant, charring low denier fibers. Inherently flame retardant fibers are known in the art and include melamines, meta-aramids, paramids, polybenzimidazole, polymides, polyamideimides, partially oxidized polyacrylonitriles, novoloids, poly(p-phenylene bezathiazoles), polyphenylene sulfides, and flame retardant viscose rayons. Additional examples are disclosed in WO 03/023108 which is hereby incorporated by reference. In particular, the present invention utilizes inherently flame retardant fibers that char upon exposure to flame or high heat. As a result of charring, nonwovens can form a barrier that interrupts the propogation of flame. Inherently flame retardant fibers include, for example, melamines, modified cellulose fibers, and viscose rayons. Modified viscose fiber is an exemplary inherently flame retardant charring fiber.

The charring action of the nonwoven can be distinguished from the action of other fire retardant materials. For example, halogenated monomers act as a fire extinguisher, where the present invention acts as a true flame barrier by preventing the materials from catching fire in the first place.

The nonwoven of the invention is substantially free of polymers made from halogenated monomers. It is known in the art to add polymers made with halogenated monomers which generate oxygen depleting gases that help to prevent ignition of volatile decomposition vapors from underlying materials. Examples of polymers made from halogenated monomers that have been used for this purpose include chloropolymeric fibers, such as those containing polyvinyl chloride or polyvinylidene homopolymers and copolymers; modacrylics, which are vinyl chloride or vinylidene chloride copolymer variants of acrylonitrile fibers; and fluoropolymeric fibers, such as those prepared from polytetrafluoroethylene (PTFE), poly(ethylenechlorotrifluoroethylene) (E-CTFE), polyvinylidene fluoride (PDVF), and polyperfluoroalkoxy (PFA) polymers. These polymers tend to be expensive, and it would be advantageous to limit the amount in a fire retardant material. Until now it has been difficult to produce a lightweight fire retardant material substantially free of polymers produced from halogenated monomers, as the reduced number of fibers that can be present in lightweight materials have been insufficient to impart the required fire retardant properties.

The fire retardancy of the material is imparted by using fibers substantially free of polymers produced from halogenated monomers, although lesser amounts of polymers produced from halogenated monomers may be used. For example, less than 10% of the polymers of the formulation are made from halogenated monomers, or less than 5% of the polymers of the formulation are made from halogenated monomers, not including any binder. Alternatively, the nonwoven can be completely free of polymers made from halogenated monomers, except for any polymers made from halogenated monomers that may be added as a binder.

In a preferred embodiment, the modified viscose fibers present in the fire retardant barrier include Visil®. KENAF, cotton, melamine fibers such as Basofil, modified cellulose fibers, or other charring fibers can be present optionally in smaller quantities. Additionally, small amounts of non-charring, inherently fire retardant fibers can be incorporated.

The barrier fibers can be made exclusively of Visil®. Visil® is a fire retardant rayon marketed by Sarteri Oy of Finland and is inherently flame retardant because of its high silica content (30-33% aluminosilicate modified silica, $SiO_2$+ $Al_2O_3$.)

Denier is a measure of weight in grams of 9,000 meters of materials. The lower or finer the denier, the more fibers per square yard at a given weight, and the better the flame barrier. A low denier fiber according to the present invention is a fiber having a denier of less than about 3.5, about 3 or less, or less than 3. Fibers having a denier greater than about 3 or 3.5 are considered higher denier.

Preferred embodiments for the nonwoven of the present invention include a blend of 25-75% fibers of 1.5 denier, and about 75-25% of fibers of 3 denier. One particular embodiment contains a blend of 1.5 and 3 denier in approximately equal parts. Other embodiments include a nonwoven comprising 1.5 denier fibers exclusively, and a nonwoven comprising 3 denier fibers exclusively. The invention also contemplates fiber blends wherein one of the fibers has a denier of greater than 3, for instance, a blend of a 7 denier fiber with a 1.5 denier fiber.

Nonwovens prepared from low denier fibers unexpectedly exhibit superior fire retardant properties, especially when compared to higher denier fibers. Higher denier fibers provide bulk and substance that would be expected to create a dense char, providing better fire protection than lightweight, fine fibers. However, the inventors have discovered that fine denier fibers, because of their lightweight, fine properties, can be used to prepare an effective fire-blocking web as described herein.

Additional embodiments of the invention include the use of a binder. Binders useful with the present invention include low-melt binder fibers such as bicomponent polyesters and polyolefins. A particular embodiment includes the use of a standard low melt polyester bicomponent fiber. Bicomponent fibers are made from two different polymer components, and can be combined, for example, by having one polymer in a core and another lower-melting polymer in a sheath around the core. Binders of varying deniers, including a combination thereof, are useful in the invention, and can range from, for example, about 4 denier to about 15 denier. The use of a higher denier binder fiber adds resiliency to the product, for example, by preventing compression during shipping.

The nonwoven can have from about 40% to about 50% fibers of 1.5 denier, from about 20% to about 35% fibers of 3 denier and from about 15% to about 30% binder. Examples are set forth in Table 1.

TABLE 1

| Sample | % 1.5 denier inherently flame retardant fibers | % 3 denier inherently flame retardant fibers | % binder | Ratio 1.5 denier:3 denier inherently flame retardant fibers | Basis weight (osf) | Loft (inches) |
|---|---|---|---|---|---|---|
| 1 | 50 | 35 | 15 | 59:41 | 0.75 | 0.75 |
| 2 | 40 | 40 | 20 | 50:50 | 0.75 | 0.75 |
| 3 | 50 | 35 | 15 | 59:41 | 0.6 | 0.6 |
| 4 | 40 | 40 | 20 | 50:50 | 0.75 | 0.625 |
| 5 | 0 | 85 | 15 | 0:100 | 0.5 | 0.5 |
| 6 | 0 | 70 | 30 | 0:100 | 0.8 | 0.5 |
| 7 | 50 | 20 | 30 | 71.4:28.6 | 0.8 | .375 |
| 8 | 40 | 40 | 20 | 50:50 | 0.5 | 0.5 |
| 9 | 35 | 35 | 30 | 50:50 | 0.75 | 0.5 |
| 10 | 40 | 40 | 20 | 50:50 | 0.6 | 0.5 |
| 11 | 55 | 30 | 15 | 64:36 | 0.65 | 0.65 |
| 12 | 55 | 30 | 15 | 64:36 | 0.85 | 0.85 |

The nonwoven flame retardant barrier of the present invention can have a basis weight ranging from about 0.25 to about 0.85 osf. In some embodiments, the basis weight is 0.5 osf or less. In the case of mattresses, the type of mattress can affect the weight of the barrier. For example, the basis weight of the nonwoven material that is suitable to impart flame resistance to a product depends on the nature of the product, such as construction and fuel load. As more flammable materials are used in construction, i.e. as the fuel load increases, the weight of the barrier material must be increased. For example, the average mattress manufacturer offers a range of products from low profile, inexpensive mattresses to thick pillow tops that are loaded with flammable foam or fiber. The weight of the barrier materials can be adjusted appropriately depending on the product that is manufactured in order to impart the needed amount of flame retardancy.

One embodiment of the present invention is directed to a highloft nonwoven flame retardant barrier. Highloft describes a low density, bulky fabric, generally having a greater volume of air than fiber. Highloft material can have, for example, about one inch thickness or more per one ounce per square foot basis weight. The purpose of a highloft characteristic is to add thickness without adding weight. Highloft products are only minimally densified or compressed, if at all, in their entirety during the manufacturing process. A highloft, nonwoven barrier of the present invention has a thickness, or loft, of about ¼ inch to about 1.5 inches. A basis weight in the range of from about 0.2 to 0.85 osf yields a density from about 3 to about 4.5 ounces per cubic foot, or ocf.

Thickness, and therefore density, as defined in this specification are determined in the material as manufactured. For example, in a thermally bonded non-woven, loft, thickness, and density are determined when the nonwoven is removed from the oven. Some compression may occur for example, during packaging or shipping, or in use.

The highloft flame barrier that is one embodiment of the present invention retains the desired characteristics of light weight and soft touch by using a low denier fiber to achieve a higher fiber density and maintaining a loft of about ¼ to 1.5 inches by carefully blending and carding fibers. Melt levels during bonding are optimized to achieve the highest possible resiliency and loft, as is known in the art.

The present invention includes flame retardant barriers of varying lofts. In articles of manufacture where fluffiness or thickness is not desired, a lower loft barrier is suitable. For example, office partitions or insulators in automobiles and aircraft are typically designed to occupy a minimum amount of space. In other products, such as appliances, fluffiness is simply unnecessary. Further, for some applications, additional layers can be added to form a composite material. The present invention contemplates all such products comprising the use of the nonwoven of the present invention, in varying lofts.

The loft of the present invention can be achieved through blending and carding of low denier fibers. The fibers are blended before carding, and can be thermally bonded, spray bonded, or needlepunched after the non-woven is formed. The invention also provides for the option of thermal bonding and needlepunching on the same line. Optionally, the loft may be further modified by passing the fibers through a calendar, which is a set of driven rolls with temperature controlled oil running through them. The oil can be heated or chilled depending on the desired effect, and the distance between the rolls can be set to control the loft or modify the surface properties of the web. After bonding and/or calendering, the fibers are slit to the appropriate width and either rolled or cut into pieces.

Although use of high denier fibers can result in resilient flame retardant products, high denier fibers produce an open fiber web with reduced fire-blocking ability. This is particularly true in lighter weight material where the number of fibers is more limited. In contrast, a blend of low denier fibers, for example, a blend of 3 and 1.5 denier, increases the number of fibers per square inch for a given weight. It is believed that this increase in fiber density improves the fire-blocking ability of the product by enhancing the char effect of the material.

For example, by reducing the denier from 7 to 3, the quantity of the fiber is increased 2.3 times. By reducing the denier from 7 to 1.5, the fiber quantity is increased 4.7 times. In an embodiment having 65% fiber of 1.5 denier and 35% fiber of 3 denier, there are 3.86 times more fibers as would be present in a nonwoven prepared exclusively from 7 denier fiber. This dramatic increase in fiber content greatly enhances the charring effect, imparting superior fire retardant ability without increasing overall weight of the nonwoven. For example, only marginal fire retardancy is achieved in a nonwoven having a basis weight of 0.75 osf when prepared from 7 denier fibers exclusively. In contrast, 0.75 osf nonwovens prepared from low denier fibers according to the present invention show very good fire retardant properties. Further, using nonwovens prepared from low denier fibers according to the present invention, the basis weight can be lowered to 0.5 osf or less, or as low as 0.2 osf and still retain sufficient fire retardancy.

In a preferred embodiment, the flame retardant barrier can be used to manufacture a mattress that meets the requirements of Cal. AB 603, which is a strict California test for mattress flammability that has been proposed as an industry standard in the United States. Under this test procedure, a twin mattress is ignited using a pair of gas burners and the rate of heat released is determined by oxygen consumption and carbon oxide ($CO_2$ and CO) release. The heat release rate is recorded until all signs of burning have ceased, 30 minutes have elapsed, or the fire is so large as to require suppression. A mattress fails the test if the heat release reaches 200 kW or has a total heat release of 25 MJ in the first 10 min of the test.

The barrier of the present invention is manufactured by carding low denier, inherently flame retardant fibers and cross-lapping the fibers to form a batt. Fibers of varying denier or different types of fibers are blended before carding for incorporation into a fiber layer. Alternatively, alternate cross-lapped layers can have different fiber contents, so that the nonwoven has an overall composition as described herein. A binder can be added to the fibers before carding so that the fibers can be thermally bonded together.

The invention also includes a batt manufactured by this process. Alternatively, the carded and lapped fibers can be needlepunched. In one embodiment, the nonwoven is a highloft with a good "feel", and is substantially fire retardant without significant densification.

The invention further relates to a method of manufacturing an article which includes carding low denier modified viscose fibers, cross-lapping the carded fibers to form a batt, and densifying the batt by rolling, thermal bonding, spray bonding, or needle punching the fibers. Articles include mattresses and furniture that can have additional layers of fire retardant and non-fire retardant materials, as is generally known in the art.

Mattresses are typically constructed by providing a deck, which is a resilient mattress material such as foam, down, non-woven, or other materials as known in the art. The deck can also include mattress support structures. According to the invention, the fire retardant barrier is then placed around the deck or mattress material, for example along the top, sides, and/or bottom. Ticking is sewn directly over the barrier. Mattress foundation can be similarly constructed. For example, the fire retardant barrier can be placed on the top and sides of the box spring, which is then covered by the ticking. The ticking is placed on the sides, over the barrier layer, and covers the edges of the top of the box spring. In one embodiment, the ticking covers a three inch perimeter of the top of the box spring.

The product for which the fire retardant barrier is being incorporated can in part determine whether fibers are densified/compressed during manufacture of the nonwoven. In many mattress and furniture applications, a "soft hand" is desired, meaning the article is comfortable to the touch. Here densification would not be suitable, as it would result in dense layers lacking a soft feel. However, in products where a soft touch is not important, needle punching or densification can be appropriate. Examples of such applications include office partitions and thermal or sound insulators for use in, for example, appliances, automobiles or aircraft. The nonwoven can be compressed and combined with other components to produce a product that has thermal insulation properties, but is thinner than a mattress. The other components may be separately prepared and bonded to the present fire retardant barrier to form a composite material. One such method of manufacture can include placing the nonwoven (compressed or non-compressed) as a layer extending along a surface, and covering the surface with a fabric. Composite materials can be highloft, for example for use in mattresses or cushions, or lowloft for other applications such as insulators.

The nonwoven barrier of the present invention is suitable for use in many commercial applications such as furniture and mattress construction. For example, such products can include bedspreads, mattress toppers, draperies, sofas, chairs, and other furniture and housewares. The combination of fibers in the weights and percentages disclosed in this specification is particularly successful in low-cost mattresses that have fewer layers of flammable material. This is significant because low-cost mattresses account for about 75% of those sold in the U.S., and so the present invention makes fire-retardant mattresses available to a large percentage of consumers, without a significant increase in cost.

Exemplary fire retardant barriers of the present invention improve upon the prior art because the barrier, and therefore the product into which it is incorporated, is lightweight as a result of using low denier fibers, for example a blend of 1.5 and 3 denier fibers. Thus the nonwoven and the product into which the nonwoven is incorporated both have a "fluffy", or soft, feel. The blend is less expensive than other fire retardant fibers, resulting in a cost-effective, lightweight product. Because of the properties of the fiber blend, fewer layers are required to produce, for example, a fire retardant, lightweight mattress having the desired soft feel.

The barrier of the present invention can also be used in the manufacture of a mattress topper or in the quilted top or sides of a mattress. Typical mattresses contain a layer of polyurethane foam or lofted fiberfil. In order to impart fire retardancy to the mattress, a layer of fire retardant materials must be inserted, such as fiberglass. The nonwoven batt of the present invention can be used to replace the fire retardant material between the mattress foam and ticking in order to meet industry and government fire retardant requirements. The foam layer itself can also be replaced with the fire retardant barrier of the present invention. This facilitates the assembly process by eliminating two layers with the single component nonwoven of the present invention. The elimination of the extra layer, at least partly offsets the cost of the charring fibers, and results in a product that is easier to produce and has superior fire retardant properties. Thus, for approximately equal cost, a mattress topper according to the present invention has greatly improved fire retardant properties, and is still soft, plush, and lightweight.

In addition to bedding applications, the present invention has automotive and acoustical applications, and can be used in appliances. The nonwoven has acoustic as well as thermal insulation properties, and can be used to insulate from sound and heat that is generated by the machines themselves, or from external heat and noise.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A non-woven flame retardant barrier comprising:

a binder; and a plurality of charring fibers combinable with the binder, wherein the charring fibers are substantially free of polymers made from halogenated monomers, consist essentially of fibers exclusively having a denier of from 1.5 to 3.5, and provide a fire-blocking web upon exposure to a heat source, wherein the barrier has a basis weight of from 0.25 to 0.65 osf.

2. The non-woven of claim 1, wherein the charring fibers comprise modified viscose fibers.

3. The nonwoven of claim 2, wherein the modified viscose fibers comprise a fire retardant rayon having a silica content of approximately 30-33% aluminosilicate modified silica.

4. The nonwoven of claim 1, wherein a basis weight of the nonwoven is about 0.5 osf or less.

5. An article comprising the nonwoven of claim 1, wherein the article meets an industry standard for mattress flammability.

6. A non-woven flame retardant barrier consisting essentially of charring fibers exclusively having a denier of from 1.5 to 3.5, substantially free of polymers made from halogenated monomers and having a basis weight of from 0.25 to 0.65 osf.

7. The nonwoven of claim 6, wherein the charring fibers comprise modified viscose fibers.

8. The nonwoven of claim 7, wherein the modified viscose fibers comprise a fire retardant rayon having a silica content of approximately 30-33% aluminosilicate modified silica.

9. The nonwoven of claim 6, wherein a basis weight of the nonwoven is about 0.5 osf or less.

10. An article comprising the nonwoven of claim 6, wherein the article meets an industry standard for mattress flammability.

11. A non-woven flame retardant barrier comprising low denier charring fibers substantially free of polymers made from halogenated monomers, wherein the low denier charring fibers consist essentially of fibers made from about 3 denier and the barrier has a maximum basis weight of about 0.75 osf.

12. The nonwoven of claim 11, wherein the charring fibers comprise modified viscose fibers.

13. The nonwoven of claim 12, wherein the modified viscose fibers comprise a fire retardant rayon having a silica content of approximately 30-33% aluminosilicate modified silica.

14. The nonwoven of claim 12, wherein the modified viscose fibers account for more than about 85% of the charring fibers, not including any binder that may be present in the formulation.

15. An article comprising the nonwoven of claim 11, wherein the article meets an industry standard for mattress flammability.

16. A non-woven flame retardant barrier consisting of charring fibers having a denier exclusively of about 3.5 or less, non-charring fibers, and binders, wherein at least one of the charring fibers is selected from the group consisting of modified viscose fibers, KENAF fibers, cotton fibers, melamine fibers, modified cellulose fibers, and the barrier has a maximum basis weight of 0.75 osf, and the barrier is substantially free of polymers made from halogenated monomers.

17. The non-woven flame retardant barrier of claim 16, wherein one of the charring fibers is modified viscose fibers.

18. A non-woven flame retardant barrier comprising flame retardant fibers, wherein the flame retardant fibers consist essentially of only low denier charring fibers, the barrier is substantially free of polymers made from halogenated monomers, and the barrier has a maximum basis weight of 0.75 osf.

19. A non-woven flame retardant barrier comprising flame retardant fibers, wherein the flame retardant fibers consist of only low denier charring fibers, the barrier is substantially free of polymers made from halogenated monomers, and the barrier has a maximum basis weight of 0.75osf.

20. A non-woven flame retardant barrier comprising:

a binder; and a plurality of charring fibers combinable with the binder, the charring fibers completely free of polymers made from halogenated monomers, wherein the charring fibers are exclusively low denier fibers up to 3.5 denier, wherein upon exposure to a heat source the charring fibers create a fire-blocking web, and wherein the barrier has a basis weight of from 0.25 to 0.65 osf.

21. The non-woven flame retardant barrier according to claim 20, wherein the binder includes polymers made from halogenated monomers.

22. The non-woven flame retardant barrier according to claim 1, wherein the barrier has a loft of from approximately 0.25 inches to 1.5 inches.

23. The non-woven flame retardant barrier according to claim 1, wherein the barrier is free of chemically treated fire retardant material.

24. The non-woven flame retardant barrier according to claim 20, wherein the binder comprises 15-30% of the barrier.

25. The barrier according to claim 1, wherein the binder comprises binder fibers.

* * * * *